United States Patent [19]

Scarano et al.

[11] Patent Number: 4,701,242

[45] Date of Patent: Oct. 20, 1987

[54] MECHANISM FOR MOVING A SHOWER NOZZLE IN A PAPER MAKING MACHINE

[75] Inventors: Robert V. Scarano; James D. Hudon, both of Glens Falls, N.Y.

[73] Assignee: Albany International Corp., Menands, N.Y.

[21] Appl. No.: 722,810

[22] Filed: Apr. 12, 1985

[51] Int. Cl.[4] ..... D21F 1/32; B08B 3/02

[52] U.S. Cl. ..... 162/275; 162/277; 239/73; 239/751; 239/752; 68/204; 134/57 R; 134/122 R; 198/495

[58] Field of Search ..... 239/73, 185, 186; 162/275, 277, 278; 198/495; 210/391; 68/204; 209/380; 134/57 R, 122 R

[56] References Cited

U.S. PATENT DOCUMENTS

| | | | |
|---|---|---|---|
| 1,459,161 | 6/1923 | Roberts | 162/277 |
| 1,553,274 | 9/1925 | Vickery | 162/199 |
| 1,606,172 | 11/1926 | Morns et al. | 162/277 |
| 1,839,508 | 1/1932 | Staege et al. | 184/6 |
| 2,273,126 | 2/1942 | McGillin | 134/57 D |
| 2,676,600 | 4/1954 | Vani et al. | 239/186 |
| 3,279,976 | 10/1966 | Eagle et al. | 162/275 |
| 3,291,681 | 12/1966 | Wolf | 162/275 |
| 3,470,064 | 9/1969 | Schwerdt | 162/314 |
| 3,593,730 | 7/1971 | Burchett | 239/185 |
| 3,617,441 | 11/1971 | Farrell | 162/199 |
| 3,739,605 | 6/1973 | Baker | 68/20 |
| 3,910,815 | 10/1975 | Shelor | 162/277 |
| 3,936,665 | 2/1976 | Donoghue | 235/151.3 |
| 3,966,544 | 6/1976 | Johnson | 162/199 |
| 4,003,784 | 1/1977 | Heim et al. | 162/199 |
| 4,152,202 | 5/1979 | De Ligt | 162/198 |
| 4,154,648 | 5/1979 | Osterberg et al. | 162/195 |
| 4,167,440 | 9/1979 | Falk | 162/277 |
| 4,207,141 | 6/1980 | Seymour | 162/49 |
| 4,218,016 | 9/1980 | Freund | 239/186 |
| 4,236,936 | 12/1980 | Schuh | 134/7 |

OTHER PUBLICATIONS

"Dryer Fabric Cleaning Shower", Lodding, a division of Thermo Electron, Application Data Sheet 117 (undated).

"Scan Jet Shower", Lodding, a division of Thermo Electron, Application Data Sheet 108A (undated).

*Primary Examiner*—S. Leon Bashore
*Assistant Examiner*—Andrew J. Anderson
*Attorney, Agent, or Firm*—Kane, Dalsimer, Sullivan, Kurucz, Levy, Eisele and Richard

[57] ABSTRACT

A motorized shower head mechanism is disclosed in which a housing is provided with a track and a trolley, and a motor mounted on the trolley. The trolley is moved along the track by the motor and a shower head which extends through the housing is carried along by the trolley.

20 Claims, 11 Drawing Figures

MECHANISM FOR MOVING A SHOWER NOZZLE IN A PAPER MAKING MACHINE

BACKGROUND OF THE INVENTION

1. Field of Invention

This invention pertains to a mechanism for moving a shower head used to clean a paper web in a papermaking machine, and more particularly to a machine with a motorized shower head moving along a stationary track.

2. Description of the Prior Art

In a papermaking machine, it is frequently necessary to rewet the paper web using a shower head. In addition, the various forming, dryer fabrics and press felts are also cleaned with a water jet to remove various foreign particles and/or to rebulk the felt or fabric. In order to insure a uniform coverage by the jet, the shower head is moved or oscillated in a reciprocal motion across the width of the web, felt or fabric. To this end the shower head is coupled to a stationary motor by a standard sprocket-and-chain arrangement. However this type of arrangement has been found to be unreliable because of frequent breakdown. In addition, under certain conditions it is desirable to direct the shower automatically to a particular zone. However, such an operation is difficult to perform with shower heads oscillated by a sprocket-and-chain because the exact location of the head at any particular moment cannot be precisely determined.

A further problem with the prior art shower head mechanism occurs when the shower head hangs up in an arbitrary location, while the motor and chain are still moving. As a result, the water jet is directed towards a single zone of paper web, fabric or felt and by the time this condition is noticed by an operator, the web, fabric or felt are frequently damaged.

OBJECTIVES AND SUMMARY OF THE INVENTION

In view of the above-described drawbacks of the prior art, a principal objective of the present invention is to provide a reliable mechanism for oscillating shower heads.

Another objective is to provide a mechanism which provides an accurate indication of the position of the shower head.

A further objective is to provide a mechanism which can indicate independently whether the head is oscillating.

Other objectives and advantages of the invention shall become apparent from the following description of the invention.

According to this invention, a shower head mechanism comprises a trolley for carrying a shower head, which is mounted on a stationary track. The trolley is provided with a motor for driving a pinion. The pinion engages a rack secured to the track. Sensors are also provided on the trolley to generate signals indicative of the position and status of the trolley. A flexible water pipe provides water to the shower head and a multiconductor cable is used to provide power to the cable and to conduct various control signals to a stationery control panel.

DETAILED DESCRIPTION OF THE INVENTION

Figure 1:
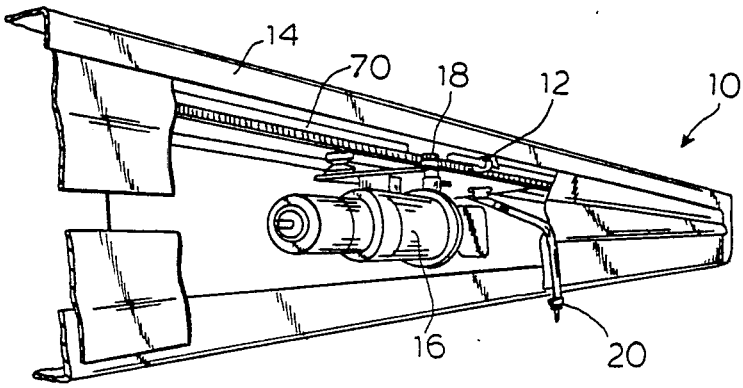
FIG. 1 shows an isometric view of the shower head mechanism constructed in accordance with the invention.

A somewhat diagramatic view of the invention is shown in FIG. 1. According to this invention a shower mechanism 10 comprises a trolley 12 movably mounted in housing 14. A drive motor 16 is secured to the trolley and is used to drive a pinion 18. The pinion 18 engages a stationary rack 70 for reciprocating movement of trolley 12. Shower head 20 is also attached to the trolley and it extends through a front wall of the housing generating a water jet. Each of these components are described in detail below in conjunction with the drawings.

Figure 2:
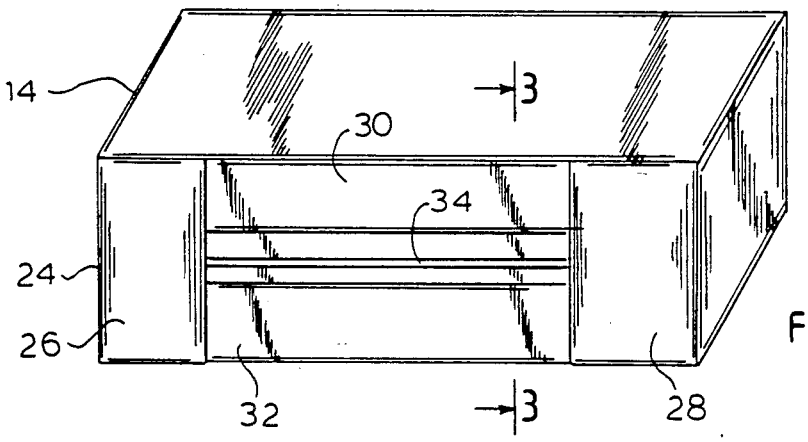
FIG. 2 shows an isometric view of the housing of the mechanism of FIG. 1.
Figure 3:
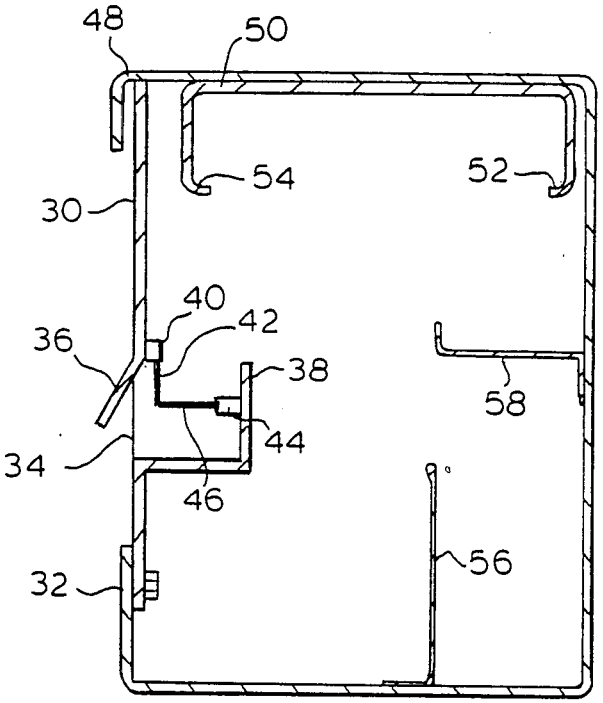
FIG. 3 is a side-sectional view of the housing of FIG. 2.

Housing 14 as shown on FIGS. 2 and 3 is generally rectangular and has a front wall 24. The front wall is provided with two blind end portions 26 and 28 and a face consisting of an upper face panel 30 and a lower face panel 32 separated by a horizontal slot 34. As shown more clearly in FIG. 3, the upper face panel 30 is provided with an outturned lip 36 while the lower face panel is provided with an L-shaped inner member 38. Attached to the inner side of upper panel 30 is an upper brush 40 with downwardly oriented bristles 42. Similarly, the L-shaped member 38 supports a lower brush 44 with bristles 46 oriented generally perpendicularly to bristles 42. The two brushes 40, 44 are provided as a flexible seal for the head.

Attached to a top inner surface of the housing and essentially coextensive therewith there is an inverted U-shaped channel 50 for supporting the track (described below). The channel is provided with two facing lips 52, 54 which are used as the track support means. On the bottom of the housing there is an upright wall 56 extending essentially along the left half of housing 14 and a horizontal wall 58 extending essentially along the right half of said housing for protecting and supporting the electric cable and pipe connected to the trolley as described below.

Figure 4:
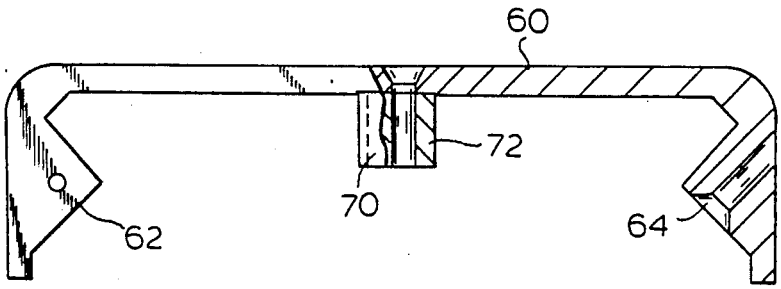
FIG. 4 shows a side-sectional view of the track of the mechanism of FIG. 1.
Figure 5:
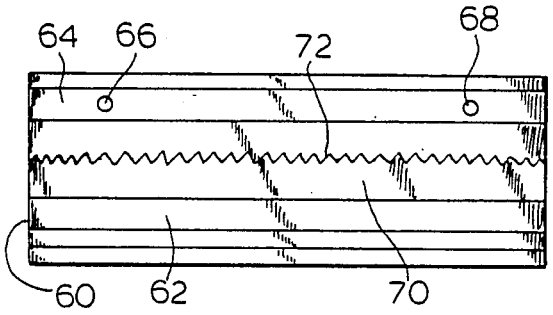
FIG. 5 shows a bottom view of the track of FIG. 4.

Attached to channel 50 there is an inverted U-shaped track 60 (see FIG. 4 and 5) which has two facing V-shaped rails 62 and 64 as shown. The track is preferably made from fiberglass by pultrusion. At the two extreme ends of the track, at least one of the rails (such as rail 64) is provided with predrilled holes 66, 68 for housing corresponding metallic screws. These screws are used as track end indicating means. A rack 70 is secured to the track by screws or similar means, generally along the longitudinal axis thereof. Along one side of the rack is provided with a plurality of teeth 72 extending along the length of the rack as shown in FIG. 5.

Figure 6:
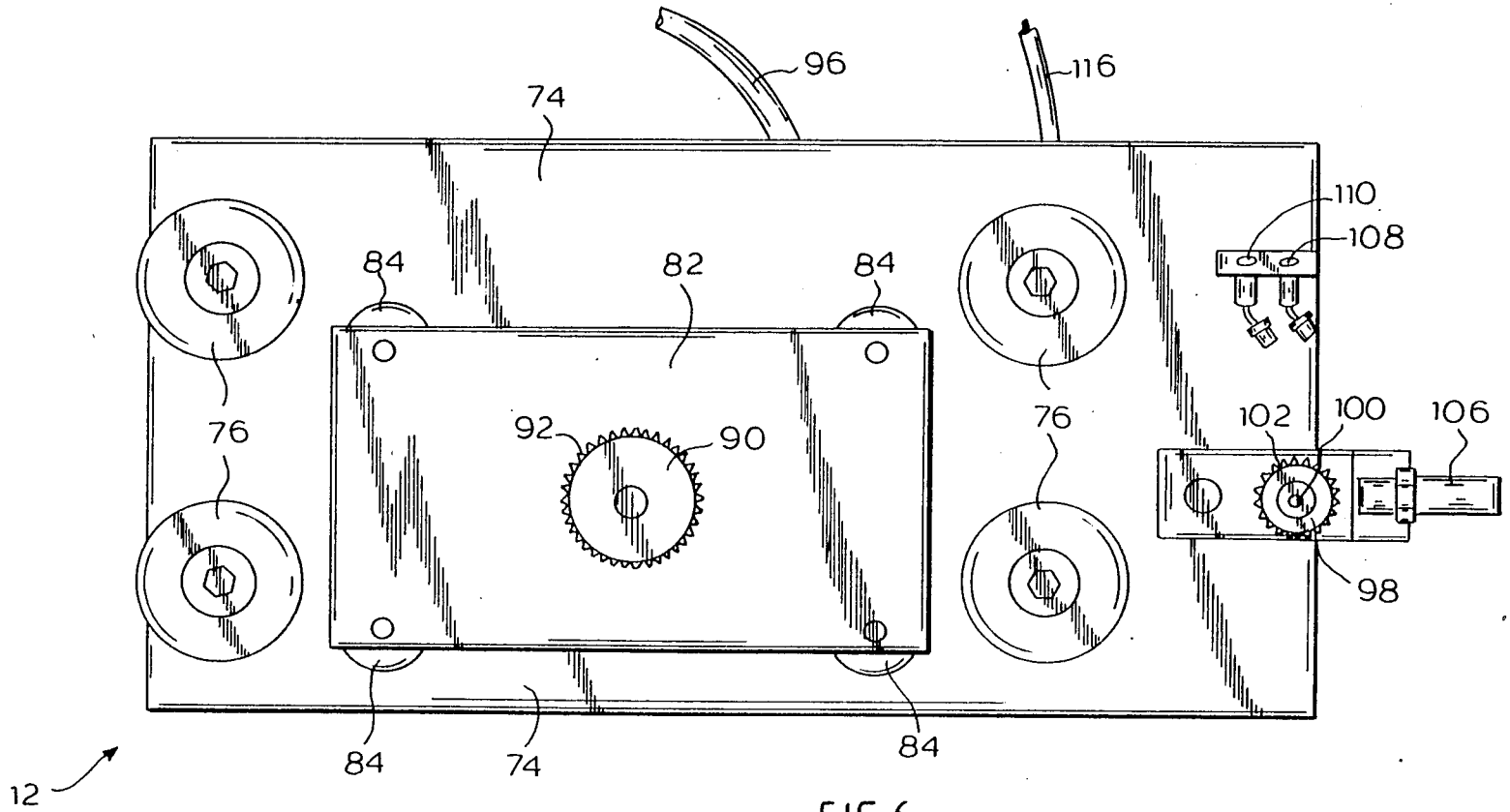
FIG. 6 shows a top view of the trolley of the mechanism of FIG. 1.
Figure 7:
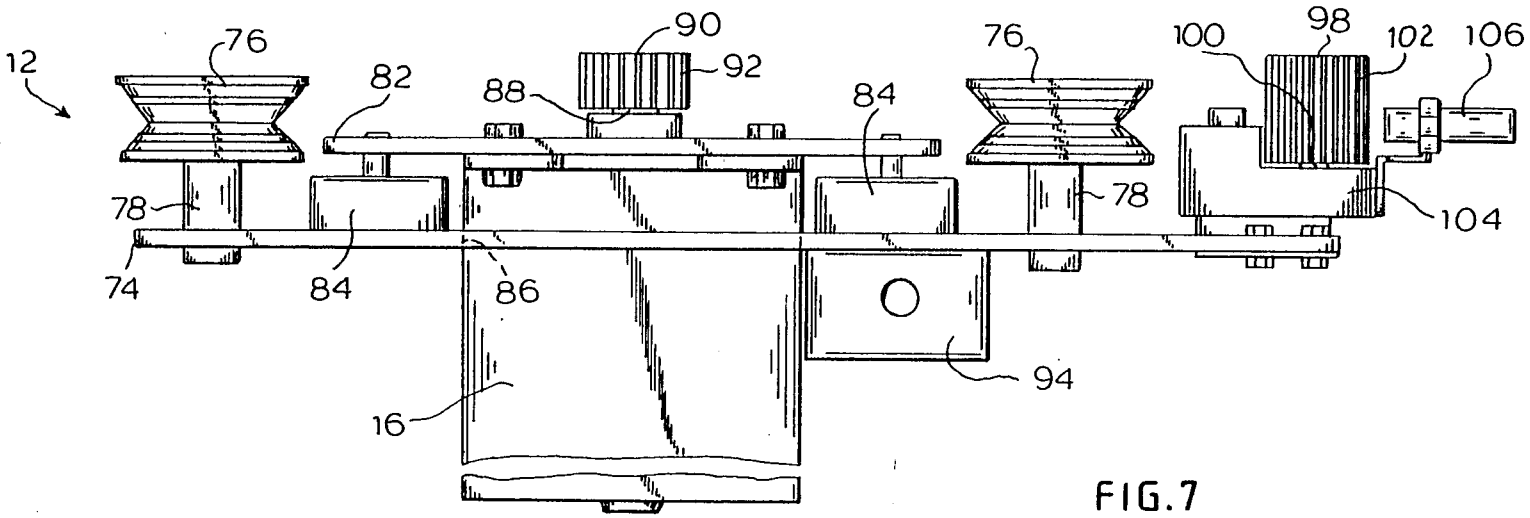
FIG. 7 is a side-sectional view of the trolley of FIG. 6.

The trolley 12 holding a stepping motor 16 and shower head 20 is shown in detail in FIGS. 6 and 7. The trolley comprises a relatively horizontal support plate 74 and a number of wheels 76 rotatably mounted to the plate by upright shafts 78. While four wheels 76 are shown it should be obvious that this number may be reduced. Each wheel 76 has a V-shaped circumferential groove 80 matching the cross-sectional shape of rails 62, 64 (FIG. 4). In operation the four wheels 76 engage and ride on tracks 62, 64. A second plate 82 is offset vertically above plate 74 by four shock absorbers 84. Plate 82 is used to support motor 16 which extends downwards through an appropriate hole 86 in plate 74. The shaft 88 of motor 16 extends upwards through plate 82 and attached to said motor shaft there is a pinion 90 having a plurality of vertical teeth 92. Teeth 92 are positioned and arranged to mesh with the teeth 72 of rack 70 when the trolley is engaged by rails 62, 64.

Adjacent to motor 16 there is provided a hose connecting means 94 for connecting water hose 96 to the shower head. At the extreme right end of plate 74, there is a second pinion 98 mounted on a shaft 100. Pinion 98 also has teeth 102 for engaging the corresponding teeth of rack 70. Pinion 98 is mounted on a support member 104 which also supports a pinion sensor 106 constructed and arranged to monitor the pinion 98. In addition two more sensors 108 and 110 are oriented to face rail 64 when the trolley rides on the two rails 62 and 64 as shown.

Figure 8:
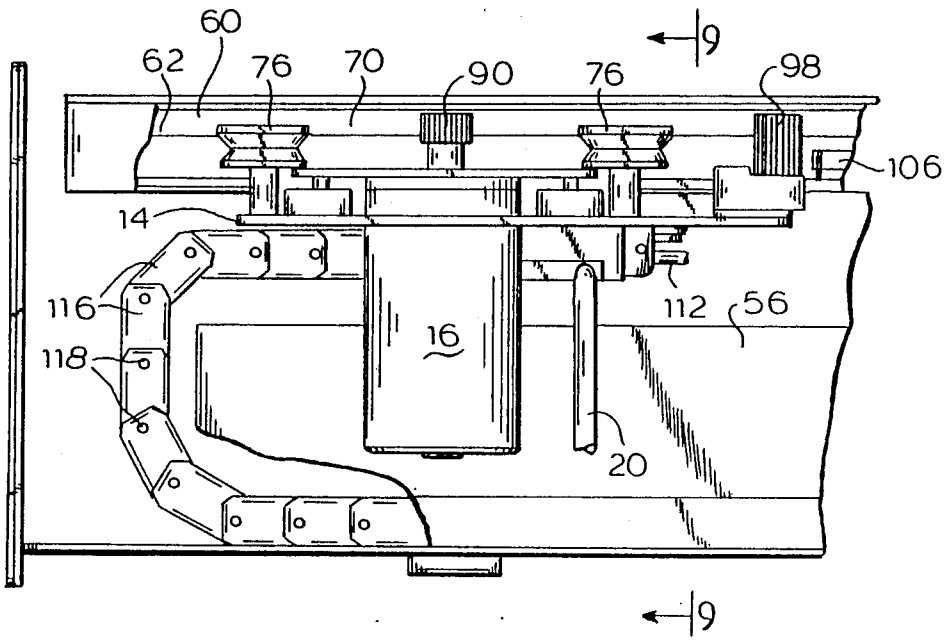
FIG. 8 shows a side elevational view of the trolley installed on a track in accordance with the invention.
Figure 9:
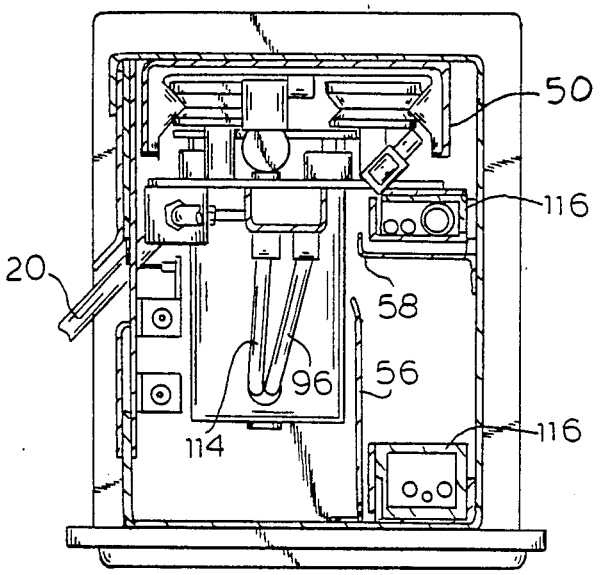
FIG. 9 shows a side view of the trolley of FIG. 8.

The assembled mechanism is shown in detail in FIGS. 8 and 9. Track 60 is supported by C-shaped channel 50 and may be removed for repair and maintenance purposes by sliding out longitudinally with respect to the housing 14. The trolley may move back and forth along rails 62, 64 of the track 60. The teeth of pinions 90 and 98 engage the corresponding teeth of rack 70. The motion of the trolley is controlled by stepping motor 16 and monitored through pinion 98 and sensor 106. Since the motor is directly coupled to the rack, no intermediary gear boxes are needed. Sensors 110 and 108 monitor the rail 64 to determine when either the right or left end of the track is reached. Preferably, sensors 106, 108 and 110 are metal-activated proximity sensors and one or more pieces of metal are embedded in the teeth of gear 98 and in holes 66 and 68 of rail 64. As pinion 98 rotates, sensor 106 generates electrical signals indicative of the motion of the trolley. By counting the number of pulses from sensor 106 and calculating their rate, the distance traveled by the trolley and its velocity may be determined. Similarly when sensors 108 and 110 detect screws in holes 68 and 66 respectively they generate appropriate left and right end of track signals. Obviously other types of sensors may also be used.

The wires for providing power to motor 16 as well as the wires from the sensors are connected to a cable 114. Preferably the cable, which is flexible to be able to follow the oscillating motion of the trolley, and water hose 96 are disposed in a flexible hose formed by a plurality of tubular members 116 of plates 116 hingedly interconnected at 118. When the trolley is disposed near the left end of the track (as seen in FIG. 8) most of the members 116 lie flat on the bottom of the housing, behind protecting wall 56. As the trolley moves to the right, the members 116 pivot upward and follow the trolley. As the trolley passes its midpoint, members 116 start sliding on support wall 58.

The shower head 20 is carried by the trolley and it extends from the housing through sealing brushes and slot 34 in a generally downwardly direction as shown in FIG. 9. Because of the shape and configuration of the face panels and the brushes, water from the shower head does not penetrate the housing.

Figure 11:
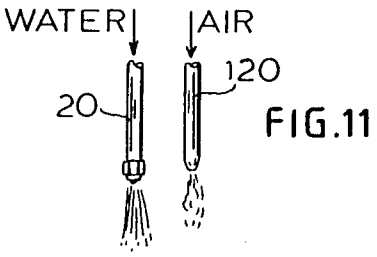
FIG. 11 shows an optional air nozzle for the mechanism of FIG. 1.

In certain situations it may be desirable to provide an air nozzle to blow air simultaneously with the water jet for drying purposes. Such a nozzle 120 may be mounted in a piggy back fashion slightly behind the water nozzle in the machine direction as shown in FIG. 11.

Figure 10:
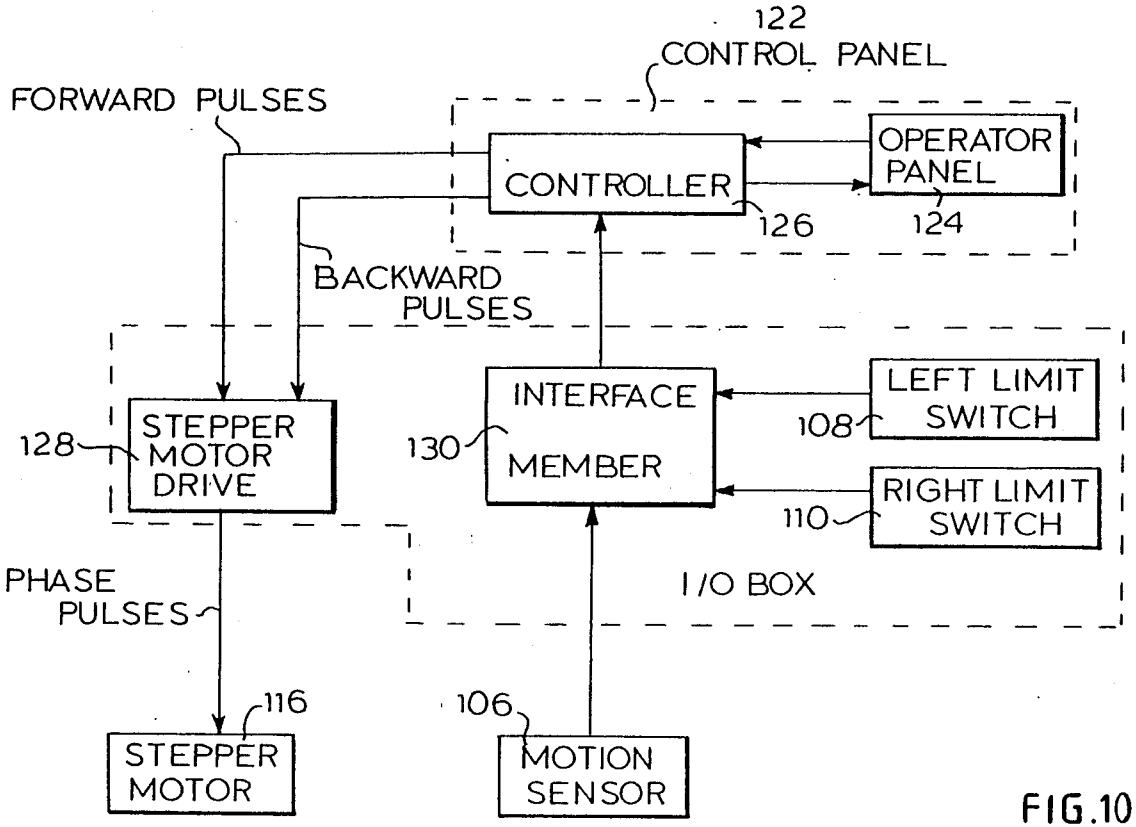
FIG. 10 shows a control circuit for the shower head motor of the mechanism of FIG. 1.

An elementary diagram for the motor and its controls is shown in FIG. 10. The operation of the shower head mechanism is controlled from a stationary control panel 122. The control panel 122 has an operational board 124 with various controls connected to an electronic controller 126 adapted to operate the motor in any predetermined fashion. The controller 126 generates forward and backward (or right/left) signals to a stepper motor drive unit 128 which may be located either in the control panel 122 or on trolley 14. The drive unit 128 then activates stepper motor 16 in discrete steps in the direction ordered by controller 126.

The signals from motor sensor 106, 108 and 110 are fed through an interface member 130 to the controller 126.

It has been found that the motorized shower head described above operates more reliably than the prior art shower head activated by a stationary motor through the use of sprockets and chains or cables. The rack-and-pinion drive system was found to be particularly reliable. The track is mounted on the ceiling of the housing so that the trolley remains clean and dry during operation.

The mechanism may have any length as required by the width of the material to be wetted.

Obviously numerous modifications may be made to the invention without departing from its scope as defined in the appended claims.

What is claimed is:

1. A mechanism for cleaning a moving material comprising:

a housing extending substantially across a width of said moving material;

a track disposed within and supported by said housing, said track being slideable with respect to said housing so as to allow the track to be slideably withdrawn or inserted into the housing;

a trolley movably supported by said track;

watering means secured to said trolley for injecting water toward said material; and a motor secured to said trolley for moving said trolley with respect to said track.

2. The mechanism of claim 1 wherein said track includes a stationary rack and a first and second facing rails, said trolley comprises rail engaging means jfor engaging said rails and supporting said trolley on the track, said trolley further comprising a pinion engaging said rack and coupled to said motor for driving said trolley on said track.

3. The mechanism of claim 2 wherein said rack is secured to said track.

4. The mechanism of claim 1 wherein said trolley comprises a first plate, a plurality of wheels for engaging said track, and a second plate supported by said first plate and secured to said motor.

5. The mechanism of claim 4 wherein said second plate is secured to said first plate by shock absorbers.

6. The mechanism of claim 5 wherein said motor has a shaft and a pinion secured to said shaft, and said track further comprises a stationary rack to which said pinion is engageable therewith.

7. The mechanism of claim 6 further comprising motion sensing means for sensing the motion of said trolley.

8. The mechanism of claim 1 wherein said track comprises a plastic material.

9. The mechanism of claim 8 further comprising position sensor means for indicating the position of said trolley.

10. The mechanism of claim 9 wherein said position sensor means comprise metal members embedded at two ends of said track, and proximity sensor means mounted on said trolley for detecting said metal members.

11. The mechanism of claim 1 further comprising means mounted on said trolley for directing a jet of air toward said material.

12. The mechanism of claim 1 wherein said housing comprises a face wall with a longitudinal slot, said watering means extending through said slot, and sealing means disposed adjacently to said slot to seal the housing interior from water.

13. The mechanism of claim 12 wherein said sealing means comprises brushes.

14. A mechanism for cleaning a moving material comprising:

a housing extending substantially across a width of said moving material;

a track disposed within and secured to said housing;

said track comprises first and second vertical track portions which slideably engage said housing and include first and second facing rails;

a trolley movably supported by said track;

watering means secured to said trolley for injecting water toward said material; and a motor secured to said trolley for moving said trolley with respect to said track.

15. The mechanism of claim 14 wherein said trolley comprises rail engaging means for engaging said rails.

16. The mechanism of claim 15 wherein said rail engaging means comprises wheels.

17. The mechanism of claim 16 wherein said rails are V-shaped and said wheels have circumferential V-shaped grooves matching said rails.

18. The mechanism of claim 14 wherein said vertical track portions are joined by a horizontal web disposed above said rails.

19. The mechanism of claim 18 wherein said housing comprises a channel secured to said housing and said track is slidably supported by said channel.

20. A mechanism for cleaning a moving material comprising:

a housing extending substantially across a width of said moving material;

a track disposed within and secured to said housing;

a trolley movably supported by said track, said trolley comprising a first plate, a plurality of wheels for engaging said track, and a second plate secured to said first plate by shock absorbers;

watering means secured to said trolley for injecting water towards said material;

a stationary rack;

a motor secured to said second plate for moving said trolley with respect to said track, said motor having a shaft and pinion secured to said shaft for engagement with said rack; and motion sensing means for sensing the motion of said trolley said motion sensing means comprising a second pinion mounted on said trolley, and engaging said rack and means coupled to said second pinion for generating signals corresonding to the rotation of said second pinion.

* * * * *